US007278685B1

(12) United States Patent
Lin

(10) Patent No.: US 7,278,685 B1
(45) Date of Patent: Oct. 9, 2007

(54) RECLINER

(75) Inventor: Yu-Hong Lin, Chayi (TW)

(73) Assignee: Tung Yu OA Co., Ltd., Chayi (TW)

( * ) Notice: Subject to any disclaimer, the term of this patent is extended or adjusted under 35 U.S.C. 154(b) by 0 days.

(21) Appl. No.: 11/428,740

(22) Filed: Jul. 5, 2006

(51) Int. Cl.
*A47C 1/024* (2006.01)

(52) U.S. Cl. ..... 297/301.7; 297/301.6; 297/365

(58) Field of Classification Search ..... 297/301.5, 297/301.6, 301.7, 363, 364, 365
See application file for complete search history.

(56) References Cited

U.S. PATENT DOCUMENTS 367,292 A * 7/1887 Hanford ..... 297/423.32
1,973,627 A * 9/1934 Harter ..... 297/363
2,130,781 A * 9/1938 Willoughby ..... 297/365
3,434,756 A * 3/1969 Walkinshaw ..... 297/301.4
4,125,288 A * 11/1978 Hunter ..... 297/301.3
4,384,741 A * 5/1983 Flum et al. ..... 297/300.5
4,966,412 A * 10/1990 Dauphin ..... 297/300.3
5,294,178 A * 3/1994 Bogle et al. ..... 297/302.4
6,213,552 B1 * 4/2001 Miotto ..... 297/300.5
6,779,847 B2 * 8/2004 Klein ..... 297/301.2

OTHER PUBLICATIONS

Taiwanese Patent M248328, Nov. 1, 2004, 3 pages.

* cited by examiner

*Primary Examiner*—Peter R. Brown
(74) *Attorney, Agent, or Firm*—Alan Kamrath; Kamrath & Associates P.A.

(57) ABSTRACT

A reclining apparatus includes a base, a reclining element and a control element. The base is arranged between a seat and a post of a chair. The reclining element is connected to a backrest of the chair and pivotally installed on the base. The reclining element defines a series of apertures. The control element is installed on the base so that the control element is moved on the base while it is rotated on the base. The control element includes a tip for removable insertion into one of the series of apertures defined by the reclining element, thus retaining the backrest on a selected one of several angular positions on the seat.

20 Claims, 6 Drawing Sheets

RECLINER

BACKGROUND OF INVENTION

1. Field of Invention

The present invention relates to a recliner and, more particularly, to a reclining apparatus for use in a recliner.

2. Related Prior Art

Disclosed in Taiwanese Patent M248328 is a reclining apparatus for use in a recliner. The reclining apparatus includes a base 12 installed on a pneumatic cylinder 18, a frame 11 pivotally installed on the base 12 and a handle 10 inserted through the frame 11 and the base 12 for controlling the pivoting of the frame 11 relative to the base 12. The base 12 includes two lateral walls each defining a cutout 121. The pneumatic cylinder 18 is used as an extensible seat post. The frame 11 includes two lateral walls. One of the lateral walls of the frame 11 defines an aperture 110. The other wall of the frame 11 defines an aperture 111. The handle 10 includes a large section 105, a reduced section 102 extended from the large section 105, a large section 104 extended from the reduced section 102, a reduced section 101 extended from the large section 104, an annular groove 103 defined in the reduced section 101 and a ridge 106 formed on the large section 105. The handle 10 inserted through the apertures 110 and 111 and the cutouts 121 so as to pivotally connect the frame 11 to the base 12. After the reduced section 101 is inserted through the aperture 110, a C-clip 13 is fit in the annular groove 103 so as to retain the handle 10 on the frame 11 and the base 12. The handle 10 can be moved between a locking position and a releasing position. In the locking position, the large section 105 and the ridge 106 are located in the aperture 11 so as to prevent the pivoting of the frame 11 on the base 12. In the releasing position, the reduced section 102 is located in the aperture 111 so as to allow the pivoting of the frame 11 on the base 12. The frame 11 can be switched between only two angular positions on the base 12.

The present invention is therefore intended to obviate or at least alleviate the problems encountered in the prior art.

SUMMARY OF INVENTION

According to the present invention, a reclining apparatus includes a base, a reclining element and a control element. The base is arranged between a seat and a post of a chair. The reclining element is connected to a backrest of the chair and pivotally installed on the base. The reclining element defines a series of apertures. The control element is installed on the base so that the control element is moved on the base while it is rotated on the base. The control element includes a tip for removable insertion into one of the series of apertures defined by the reclining element, thus retaining the backrest on a selected one of several angular positions on the seat.

It is the primary advantage of the reclining apparatus of the present invention to provide several angular positions of the backrest on the seat of the chair.

Other advantages and features of the resent invention will become apparent from the following description referring to the drawings.

BRIEF DESCRIPTION OF DRAWINGS

The present invention will be described through detailed illustration of the preferred embodiment referring to the drawings.

DETAILED DESCRIPTION OF PREFERRED EMBODIMENT

Figure 1:
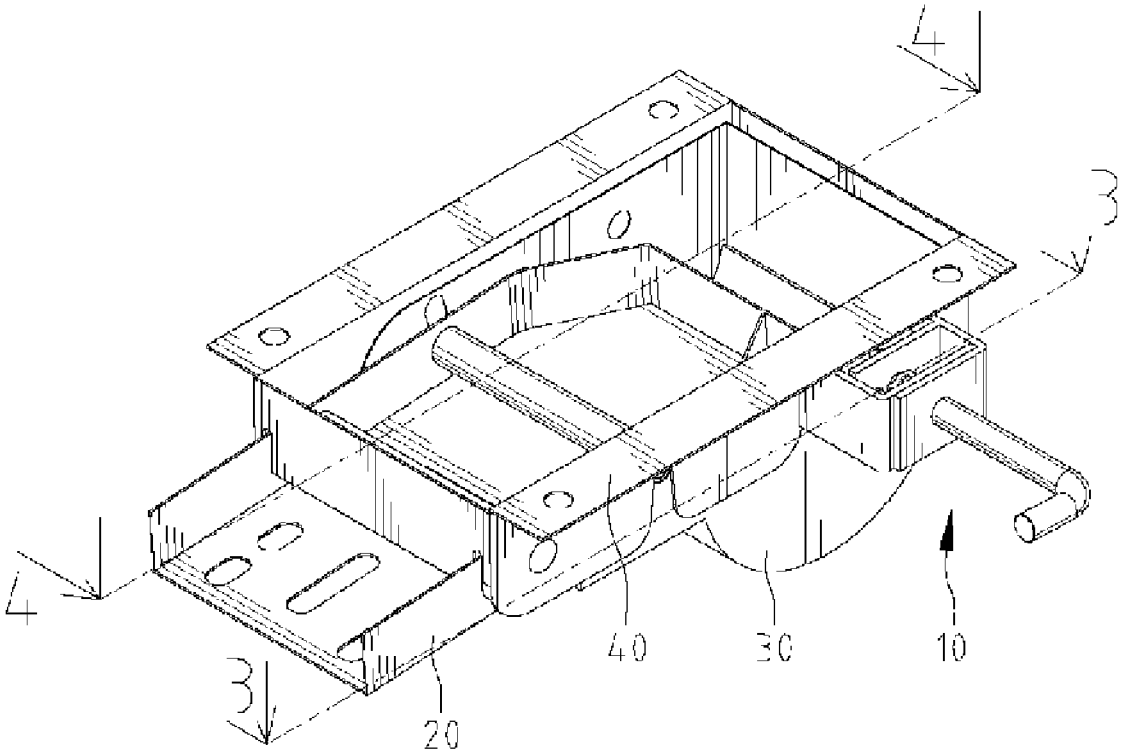
FIG. 1 is a perspective view of a reclining apparatus according to the preferred embodiment of the present invention.
Figure 4:
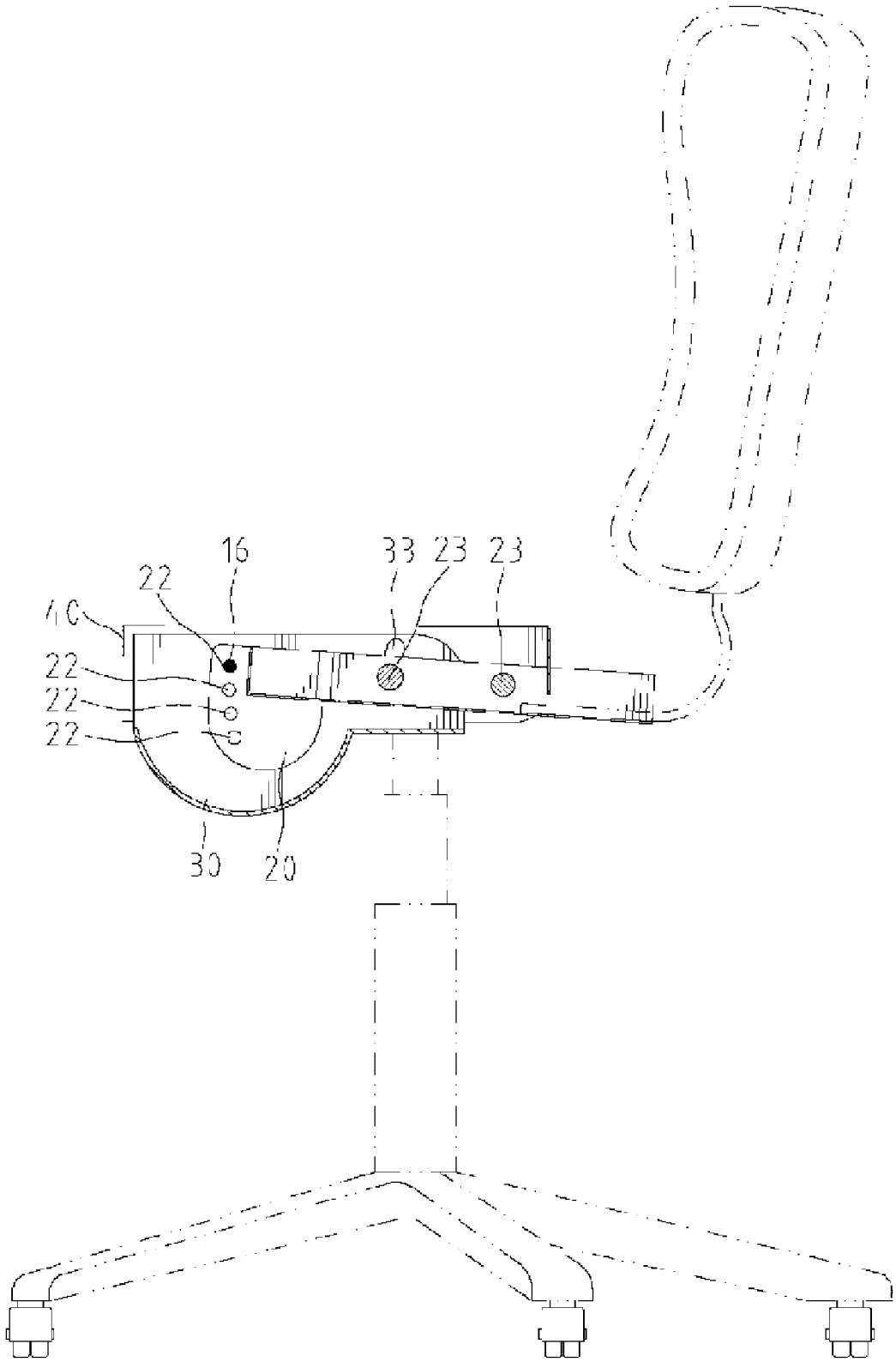
FIG. 4 is a cross-sectional view of the reclining apparatus taken along a line 4-4 in FIG. 1.
Figure 6:
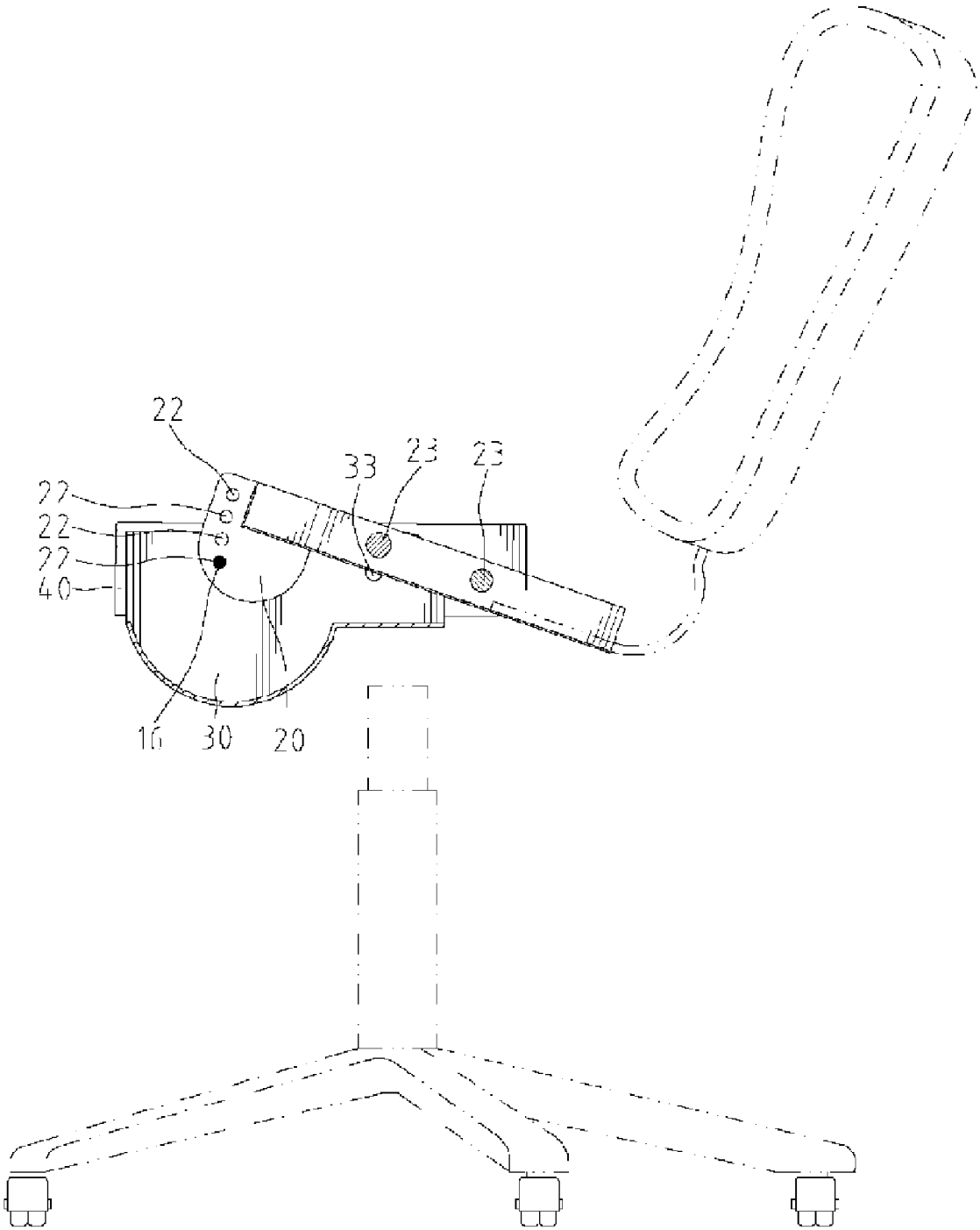
FIG. 6 is a cross-sectional view of the reclining apparatus in another position than shown in FIG. 4.

Referring to FIG. 1, there is shown a reclining apparatus 10 for use in a recliner according to the preferred embodiment of the present invention. Referring to FIGS. 4 and 6, the reclining apparatus 10 is installed on a post of a chair while a seat and a backrest of the chair are installed on the reclining apparatus.

Figure 2:
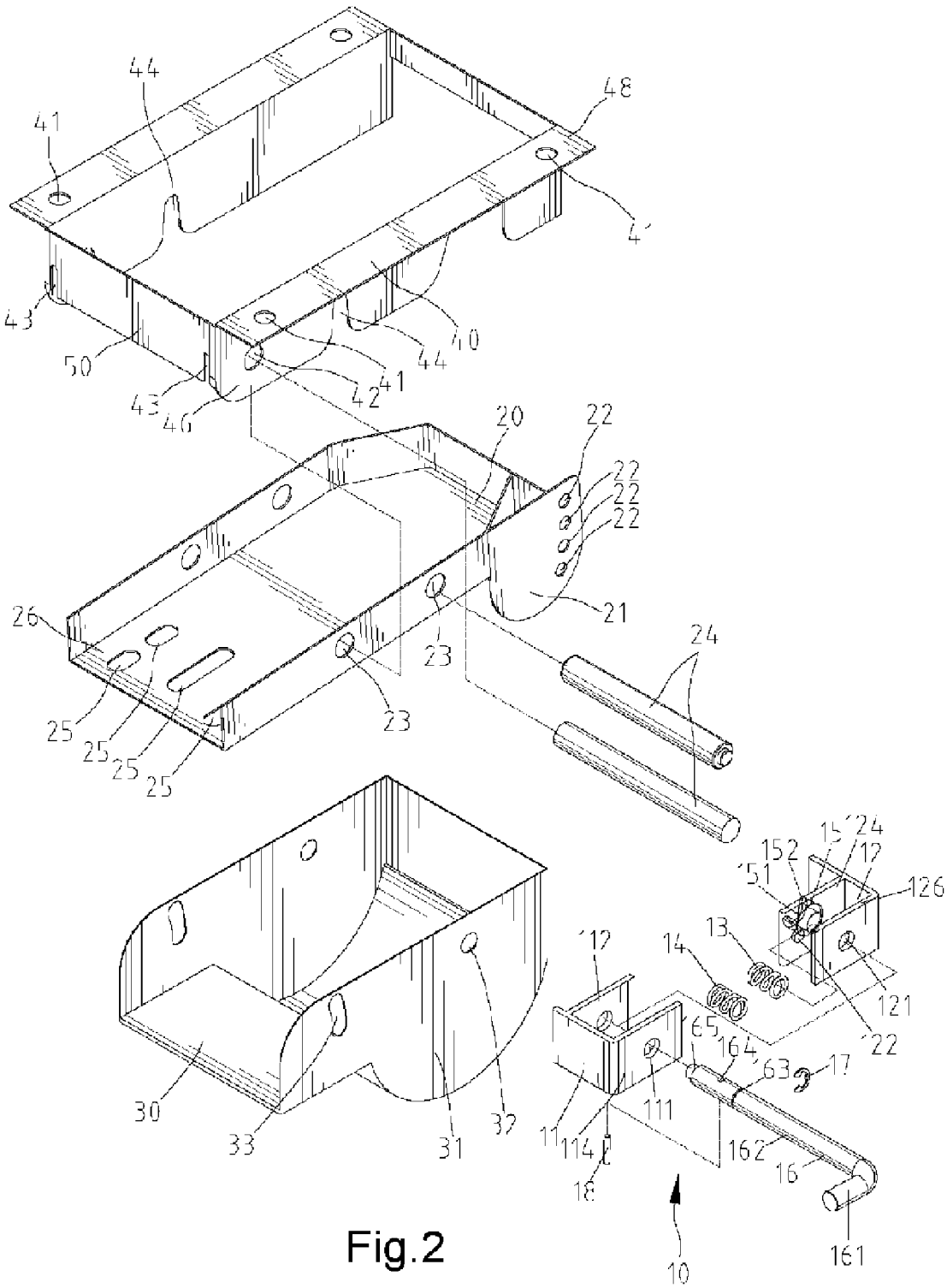
FIG. 2 is an exploded view of the reclining apparatus shown in FIG. 1.

Referring to FIG. 2, the reclining apparatus 10 includes a base 30, a frame 40 and a reclining element 20. The base 30 is installed on the post. In the preferred embodiment, the frame 40 is secured to the base 30 while the reclining element 20 is pivotally installed on the frame 40. In another embodiment, the frame 40 may be pivotally installed on the base 30 while the reclining element 20 is secured to the frame 40. In either way, the reclining element 20 is pivotally installed on the base 30, directly or indirectly.

The base 30 includes two lateral walls 31 each defining an arched slot 33 and an apertures 32.

The frame 40 includes two lateral walls 46, a rear wall 50 extended between the lateral walls 46 and two flanges 48 extended from the lateral walls 46. Each of the flanges 48 defines two apertures 41. Fasteners can be driven into the seat through the apertures 41, thus securing the seat to the frame 40. Each of the lateral walls 46 defines an aperture 42 and a slit 44. The slits 44 are located corresponding to the arched slots 33. The rear wall 50 defines two slits 43.

The reclining element 20 includes two lateral walls 21 and a floor 26 extended between the lateral walls 21. The lateral walls 21 of the reclining element 20 are located in the slits 43 defined in the rear wall 50 of the frame 40. The floor 26 of the reclining element 20 defines a plurality of slots 25. The slots 25 allow the adjustment of the position of the backrest on the reclining element 20. Each of the lateral walls 21 defines a first aperture 23 and a second aperture 23. One of the lateral walls 21 defines a series of apertures 22 located along an arch centered at the first aperture 23. A first pin 24 is inserted in the first apertures 23 of the reclining element 20 and the apertures 42 of the frame 40, thus pivotally connecting the reclining element 20 to the frame 40. A second pin 24 is inserted in the second apertures 23 of the reclining element 20 and the arched slots 33 of the base 30. Fasteners can be driven into the backrest through the slots 25, thus connecting the backrest to the reclining element 20.

There is a bracket 11 secured to the lateral wall 21 of the reclining element 20, which defines the series of apertures 22. The first bracket 11 includes two lateral walls 112 and 114. Each of the lateral walls 112 and 114 defines an aperture 111.

There is another bracket 12 including two lateral walls 124 and 126. Each of the lateral walls 124 and 126 defines an apertures 121. Formed on a side of the lateral wall 124 is a boss 122. Formed on an opposite side of the lateral wall 124 is a ring 15 around the aperture 121. The ring 15 includes an inclined edge 151 and a flat edge 152.

There is a control element 16 including a handle 161 and a latch 162 extended from the handle 161. The latch 162 includes a tip 165 with a reduced diameter, an aperture 164 defined near the tip 165 and an annular groove 163 defined near the aperture 164.

Figure 3:
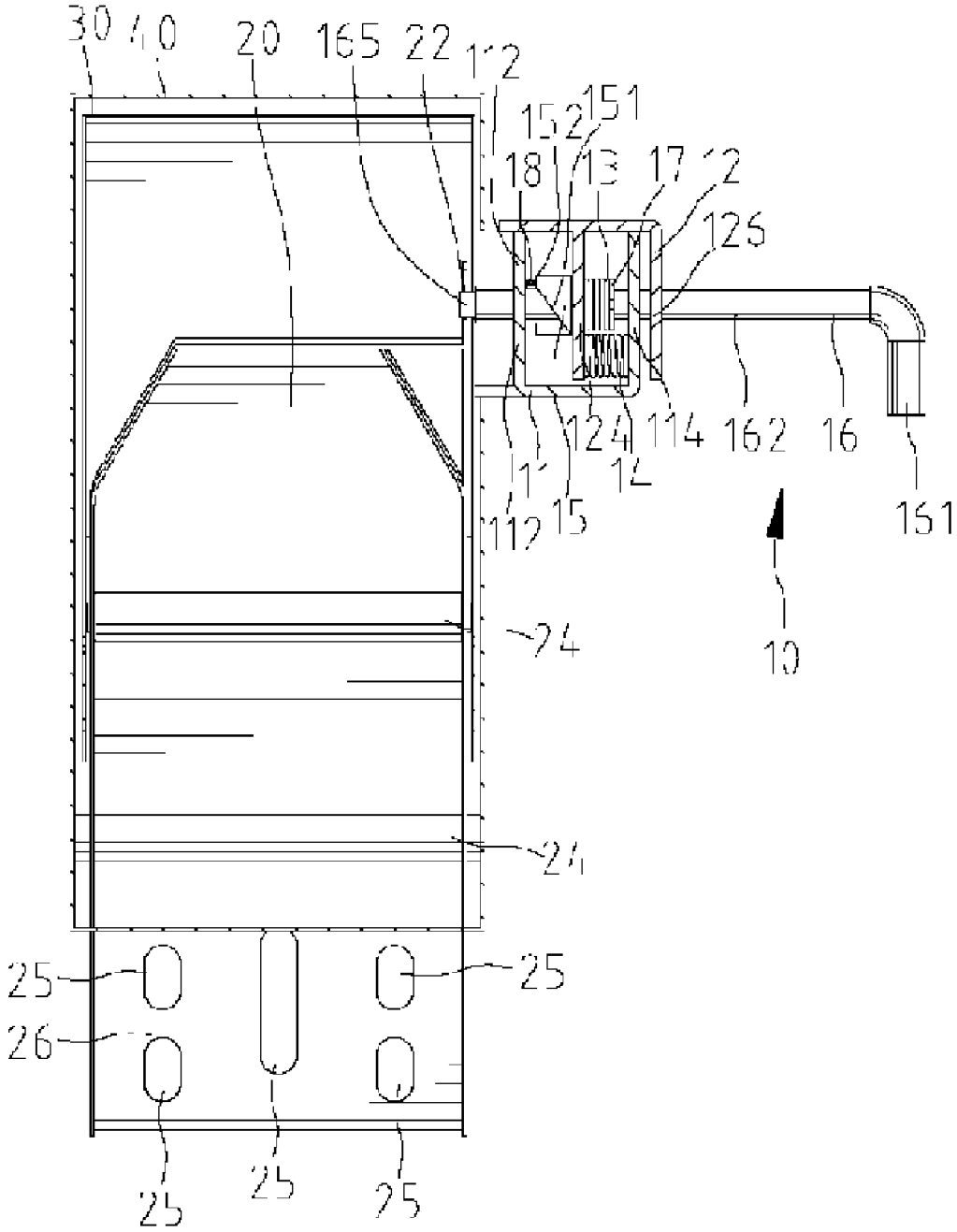
FIG. 3 is a cross-sectional view of the reclining apparatus taken along a line 3-3 in FIG. 1.

Referring to FIG. 3, the lateral wall 124 of the bracket 12 is located between the lateral walls 112 and 114 of the bracket 11. Two springs 13 and 14 are compressed between the lateral wall 124 of the bracket 12 and the lateral wall 114 of the bracket 11. The boss 122 is fit in the spring 14, thus positioning the spring 14. The latch 162 is inserted through the apertures 121 of the bracket 12, the apertures 111 of the bracket 11, the spring 13 and the ring 15. A C-clip 17 is fit in the annular groove 163, thus joining the brackets 11 and 12 and the spring 13. A pin 18 is inserted through the aperture 164. The pin 18 can be moved along the inclined edge 151 of the ring 15.

Referring to FIGS. 3 and 4, the tip 165 is inserted in a selected one of the series of apertures 22. Thus, the reclining element 20 is retained on an angular position on the frame 40. The pin 18 is located on the flat edge 152 of the ring 15. The spring 14 keeps the C-clip 17 away from the lateral wall 114 of the bracket 11.

Figure 5:
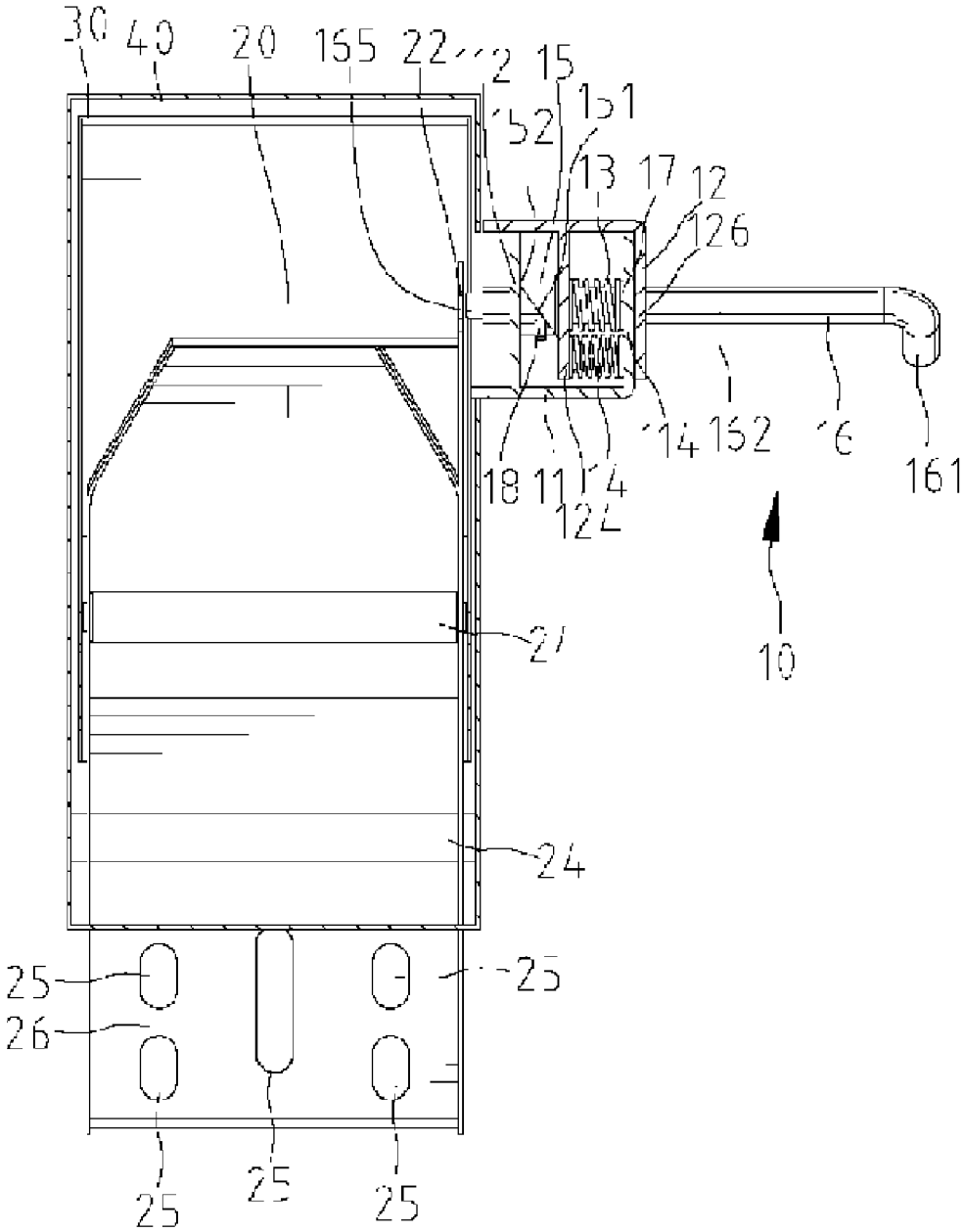
FIG. 5 is a cross-sectional view of the reclining apparatus in another position than shown in FIG. 3.

Referring to FIG. 5, the handle 161 is operated for rotating the latch 162. The pin 18 is rotated and moved along the inclined edge 151 of the ring 15. The spring 13 pushes the C-clip 17 and hence the latch 162 so that the tip 165 of the latch 162 is removed from the series of apertures 22. Thus, the reclining element can be pivoted on the frame 40.

Referring to FIG. 6, when the handle 161 is released, the top 165 is inserted in another of the series of apertures 22 by the springs 13 and 14. Thus, the reclining element 20 is retained on another angular position on the frame 40.

The reclining apparatus of the present invention exhibits several advantages. Firstly, it provides several angular positions of the backrest on the seat of the chair. Secondly, the control element can easily be operated in a rotational manner.

The present invention has been described through the illustration of the preferred embodiment. Those skilled in the art can derive variations from the preferred embodiment without departing from the scope of the present invention. Therefore, the preferred embodiment shall not limit the scope of the present invention defined in the claims.

What is claimed is:

1. A reclining apparatus comprising:

a base arranged between a seat and a post of a chair;

a reclining element connected to a backrest of the chair and pivotally installed on the base;

a series of apertures defined in one of the base and the reclining element; and a control element installed on the other of the base and the reclining element so that the control element is moved relative to the base, with the control element comprising a tip for removable insertion into one of the series of apertures, thus retaining the backrest on a selected one of several angular positions on the seat, wherein the control element comprises a latch for removable insertion in an insertion direction in a selected one of the series of apertures, with the latch rotatably mounted about an axis parallel to the insertion direction, and wherein the control element further comprises a handle operable for rotating the latch about the axis.

2. The reclining apparatus according to claim 1 wherein the control element is moved on the base and the series of apertures are defined in the reclining element.

3. The reclining apparatus according to claim 1 comprising a pin installed on the control element and a ring installed on the base and formed with an inclined edge along which the pin is moved for moving the control element while the control element is rotated.

4. The reclining apparatus according to claim 1 comprising a frame arranged between the base and the reclining element.

5. The reclining apparatus according to claim 4 wherein the frame is secured to the base while the reclining element is pivotally installed on the frame.

6. The reclining apparatus according to claim 5 comprising a pin for pivotally installing the reclining element on the frame.

7. The reclining apparatus according to claim 6 wherein the frame comprises two lateral walls each defining an aperture for receiving the pin, wherein the reclining element comprises two lateral walls each defining an aperture for receiving the pin.

8. The reclining apparatus according to claim 4 wherein the frame defines a plurality of apertures through which fasteners can be driven into the seat.

9. The reclining apparatus according to claim 1 wherein the reclining element defines a plurality of slots through which fasteners can be driven into the backrest.

10. The reclining apparatus according to claim 1 wherein the tip of the latch comprises a reduced tip for removable insertion in a selected one of the series of apertures, with a diameter at an end of the reduced tip being smaller than a diameter of the latch.

11. The reclining apparatus according to claim 1 wherein the handle is attached to the latch perpendicularly to the axis.

12. The reclining apparatus according to claim 1 further comprising:

a pin inserted through the latch, with the latch being biased in the insertion direction away from the series of apertures; and a ring mounted relative to the series of apertures and formed with an inclined edge at a non-parallel angle to the insertion direction along which the pin is moved, with the latch moving along the axis parallel to the insertion direction while the latch is rotated moving the pin on the inclined edge, with the ring positioned between the pin and the handle.

13. The reclining apparatus according to claim 12 further comprising:

a first bracket secured to the base and formed with a first lateral wall and a second lateral wall;

a second bracket formed with a lateral wall located between the first and second lateral walls of the first bracket, wherein the latch is movably inserted through the first and second lateral walls of the first bracket and the lateral wall of the second bracket;

a stop installed on the latch;

a first elastic element compressed between the stop and the lateral wall of the second bracket biasing the stop in a direction non-parallel to the insertion direction; and a second elastic element biasing the latch in the insertion direction away from the series of apertures, with the second elastic element compressed between the second lateral wall of the first bracket and the lateral wall of the second bracket, thus pushing the stop from the second lateral wall of the first bracket.

14. The reclining apparatus according to claim 13 wherein the tip of the latch comprises a reduced tip for removable insertion in a selected one of the series of apertures, with a diameter at an end of the reduced tip being smaller than a diameter of the latch.

15. A reclining apparatus comprising:

a base arranged between a seat and a post of a chair;

a reclining element connected to a backrest of the chair and pivotally installed on the base, the reclining element defines a series of apertures;

a control element installed on the base so that the control element is moved on the base while it is rotated on the base, the control element comprising a tip for removable insertion into one of the series of apertures defined by the reclining element, thus retaining the backrest on a selected one of several angular positions on the seat;

a first bracket secured to the base and formed with a first lateral wall and a second lateral wall;

a second bracket formed with a lateral wall located between the first and second lateral walls of the first bracket, wherein the control element is movably inserted through the first and second lateral walls of the first bracket and the lateral wall of the second bracket;

a C-clip installed on the control element;

a pin inserted through the control element;

a first elastic element compressed between the C-clip and the lateral wall of the second bracket;

a second elastic element compressed between the second lateral wall of the first bracket and the lateral wall of the second bracket, thus pushing the C-clip from the second lateral wall of the first bracket; and a ring formed on the lateral wall of the second bracket and formed with an inclined edge along which the pin is moved for moving the control element while the control element is rotated.

16. The reclining apparatus according to claim 15 wherein the ring comprises a flat edge extended from the inclined edge for positioning the pin.

17. The reclining apparatus according to claim 15 wherein the control element is inserted through the first elastic element.

18. The reclining apparatus according to claim 15 wherein the lateral wall of the second bracket comprises a boss inserted in the second elastic element.

19. The reclining apparatus according to claim 15 wherein the control element defines an annular groove for receiving the C-clip.

20. A reclining apparatus comprising:

a base arranged between a seat and a post of a chair;

a reclining element connected to a backrest of the chair and pivotally installed on the base, the reclining element defines a series of apertures;

a control element installed on the base so that the control element is moved on the base while it is rotated on the base, the control element comprising a tip for removable insertion into one of the series of apertures defined by the reclining element, thus retaining the backrest on a selected one of several angular positions on the seat; and a frame arranged between the base and the reclining element, wherein the frame is secured to the base while the reclining element is pivotally installed on the frame;

a pin for pivotally installing the reclining element on the frame, wherein the frame comprises two lateral walls each defining an apertures for receiving the pin, wherein the reclining element comprises two lateral walls each defining an aperture for receiving the pin; and an additional pin inserted through the lateral walls of the reclining element, wherein each of the lateral walls of the frame defines a slit for receiving the additional pin, wherein the base comprises two lateral walls each defining a slot for receiving the additional pin so that the pivoting of the reclining element on the base is confined within a predetermined range.

* * * * *